US006172647B1

(12) United States Patent
Jones

(10) Patent No.: US 6,172,647 B1
(45) Date of Patent: Jan. 9, 2001

(54) REMOTE CONTROL FOR USE WITH A DEICING APPARATUS

(75) Inventor: Thaddeus M. Jones, Bremen, IN (US)

(73) Assignee: MSX, Inc., South Bend, IN (US)

( * ) Notice: Under 35 U.S.C. 154(b), the term of this patent shall be extended for 0 days.

(21) Appl. No.: 09/333,715

(22) Filed: Jun. 15, 1999

Related U.S. Application Data

(63) Continuation-in-part of application No. 09/188,068, filed on Nov. 6, 1998, now Pat. No. 6,104,352.

(51) Int. Cl.[7] ..... H01Q 1/02
(52) U.S. Cl. ..... 343/704; 219/213; 392/422
(58) Field of Search ..... 343/704; 219/213; 392/422, 426, 424; H01Q 1/02

(56) References Cited

U.S. PATENT DOCUMENTS 6,100,851 * 8/2000 Jones ..... 343/704
6,104,351 * 8/2000 Jones ..... 343/704
6,104,352 * 8/2000 Jones ..... 343/704

* cited by examiner

*Primary Examiner*—Hoanganh Le
(74) *Attorney, Agent, or Firm*—Taylor & Aust, P.C.

(57) ABSTRACT

An antenna reflector assembly includes a reflector having a reflecting surface and an electrical heater for heating the reflecting surface. An ambient condition sensor senses an ambient temperature and/or an ambient moisture associated with an ambient environment and applies electrical power to the heater dependent upon the ambient temperature and/or the ambient moisture. A test device is connected to a source of electrical power. The test device includes a circuit breaker for cutting off an input current to the test device when the input current exceeds a predetermined threshold current. A ground fault circuit interrupter detects a ground fault condition and cuts off an electrical current associated with the ground fault condition. A current indicator senses a current through the heater and provides an indication thereof. At least one voltage indicator senses a voltage and provides an indication thereof.

18 Claims, 7 Drawing Sheets

REMOTE CONTROL FOR USE WITH A DEICING APPARATUS

This is a continuation-in-part of U.S. patent application Ser. No. 09/188,068, entitled "REMOTE TESTING AND MONITORING APPARATUS FOR USE WITH ANTENNA REFLECTOR DEICING SYSTEMS", filed Nov. 6, 1998 now U.S. Pat. No. 6,104,352.

BACKGROUND OF THE INVENTION

1. Field of the Invention

The present invention relates to an apparatus for remote testing and monitoring of electric heaters, and, more particularly, to an apparatus for remote testing and monitoring of electric heaters used to melt and thus remove snow and ice from pavement, roofs, gutters, down spouts, satellite dishes and the like.

2. Description of the Related Art

Electric heaters may be utilized to supply heat used in snow and ice melting systems. Typical melting applications include but are not limited to satellite dishes, roofs and gutters, pavement, building and garage entrances and facilities accommodating the physically challenged. Efficient operation requires embedding the electric heaters in or attaching the electric heaters to satellite dishes, pavement and other structures which may sometimes become covered with snow and ice.

Snow and ice melting systems commonly employ automatic ON/OFF controls that operate heaters only while required to minimize energy consumption and operating costs. Typically, the automatic ON/OFF controls sense ambient moisture and temperature. However, it is also possible for the automatic ON/OFF control to be in the form of a thermostat which only senses ambient temperature. Heaters operate at ambient temperatures below a threshold—usually 38° F. while ambient moisture is present and for a period of time thereafter to clear accumulated snow and ice. Optionally, the automatic ON/OFF control may inhibit heater operation at temperatures too low for effective melting, e.g., below 17° F. Status indicators and a manual control and test switch are typically included in the same package with such automatic ON/OFF controls.

In order to reduce costs and simplify installation, it is known to attach the automatic ON/OFF control package to the support structure of a satellite dish antenna, or "reflector". A problem with attaching the control package to the support structure of a reflector is that it requires access to the reflector in order to observe the status indicators and to test deicing system performance with the manual control and test switch. Since the reflector must be placed within the line of sight of the associated satellite for reliable communications, the reflector must almost always be placed at an elevated location, such as on a rooftop or a pole. Thus, nearly all antenna locations are not easily accessible for purposes of observing and testing deicing system performance.

In a known method of attaching the control package to the support structure of a reflector, a hole is drilled in a support arm thereof. Using the drilled hole, a bracket is bolted to the support arm of the reflector, and the control package is attached to the bracket. A problem is that this is a cumbersome process that requires specialized tools.

Moreover, in many retail applications, frequent relocation of the reflector is required. While the reflector itself is typically not relocated because it would not be cost effective to do so, it is cost effective to transfer the automatic ON/OFF control package along with the associated wiring to the new reflector location. A problem is that the cumbersome process of attaching the control package must be repeated at the new reflector location. An additional problem is that the bolt securing the control package to the first reflector may be rusty from exposure to the elements, making its removal extremely difficult.

Ground current is the difference between the outbound and return heater currents. The U.S. National Electric Code requires using a ground fault circuit interrupter (GFCI) on all snow and ice melting circuits. The GFCI interrupts heater current if the ground current exceeds a predetermined limit; usually 30 milliamperes. The GFCI requires manual reset after tripping. This preserves safety by not restarting heater operation during intermittent ground leakage current that may occur in wet locations.

Independent of the heater fabrication method, ground current can flow due to a heater failure caused by a manufacturing defect, corrosion, wear and tear or mechanical damage. Excessive ground current causes the dual safety problems of fire and shock hazard. An electrical shock hazard can also occur whenever ground current flows since its path to earth ground is usually not predictable. Thus, a GFCI is required to be incorporated into snow and ice melting electrical circuits. It is known to install a residential GFCI in a knockout box convenient to the deicing system. A problem is that this task must be performed by an electrician, thereby adding to the cost of transferring the heater circuitry when a new reflector location is needed.

Until recently, reflectors have almost always measured at least 1.8 meters across for very small aperture terminal (VSAT) applications. These 1.8 meter reflectors require over 650 watts of deicing power, which is enough to justify the cost of automatic ON/OFF controls in most climates. Due to improvements in ground and space equipment, smaller antennas measuring no more than 1.2 meters across have become practical. These 1.2 meter reflectors require only approximately 250 watts of deicing power for the lower half of the reflector, which is not enough to justify the cost of automatic ON/OFF controls in most climates. Nevertheless, automatic ON/OFF controls are almost universally used with 1.2 meter reflectors because of the desirability of the status indicators and the manual control and test switch that are included in the same package as the automatic ON/OFF controls. Thus, a problem is that automatic ON/OFF controls are often used in applications in which their cost is not warranted.

What is needed in the art is a device for testing and monitoring the operation of a reflector deicing system that is conveniently accessible to operating personnel, has high durability, can be easily transferred between reflector locations, and which does not require the use of expensive automatic ON/OFF controls.

SUMMARY OF THE INVENTION

The present invention provides a reflector deicing system monitor and test unit that is disposed remotely from the reflector at a location that is convenient for operating personnel to access. A current indicator includes a reed relay and a neon light bulb which both visually indicates the presence of current in the reflector heater and prevents the occurrence of electrical arcing in the relay.

The invention comprises, in one form thereof, an antenna reflector assembly including a reflector having a reflecting surface and an electrical heater for heating the reflecting surface. An ambient condition sensor senses an ambient temperature and/or an ambient moisture associated with an ambient environment and applies electrical power to the heater dependent upon the ambient temperature and/or the ambient moisture. A test device is connected to a source of electrical power. The test device includes a circuit breaker for cutting off an input current to the test device when the input current exceeds a predetermined threshold current. A ground fault circuit interrupter detects a ground fault condition and cuts off an electrical current associated with the ground fault condition. A current indicator senses a current through the heater and provides an indication thereof At least one voltage indicator senses a voltage and provides an indication thereof.

An advantage of the present invention is that access to the reflector is not needed in order to observe deicing system status indicators and to test deicing system performance.

Another advantage is that testing and monitoring of the deicing system can be performed without the expense of an automatic ON/OFF control.

Yet another advantage is that arcing within a relay of a current indicator is inhibited, thereby lengthening the operational life of the relay.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate one preferred embodiment of the invention, in one form, and such exemplifications are not to be construed as limiting the scope of the invention in any manner.

DETAILED DESCRIPTION OF THE INVENTION

Figure 1:
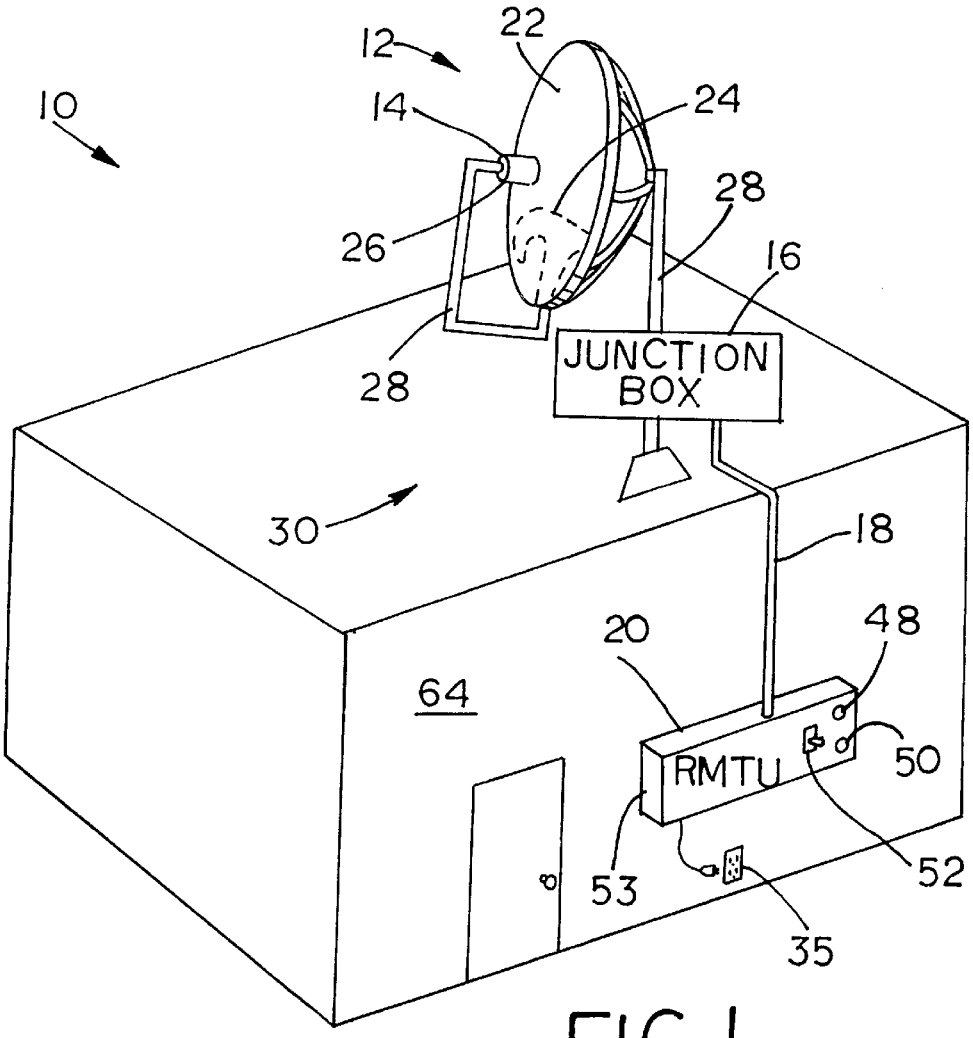
FIG. 1 is a perspective view of one embodiment of the antenna reflector deicing system of the present invention.

Referring now to the drawings and particularly to FIG. 1, there is shown a perspective view of an embodiment of an antenna reflector assembly 10 of the present invention. Antenna reflector assembly 10 generally includes reflector 12, feedhorn 14, junction box 16, multi-conductor cable 18 and remote monitor and test unit (RMTU) 20.

Reflector 12 includes a reflecting surface 22 having an electrical wire heater 24. Reflecting surface 22 can be a non-conductive plastic material, in which case heater 24 can be embedded therein. Reflective surface 22 can also be metal, in which case heater 24 can be taped or otherwise adhered to surface 22. Similarly, feedhorn 14 includes an electrical wire heater 26 connected in series with heater 24. Each of reflector 12 and feedhorn 14 is mounted upon a respective support arm 28 of a support structure 30.

Figure 3:
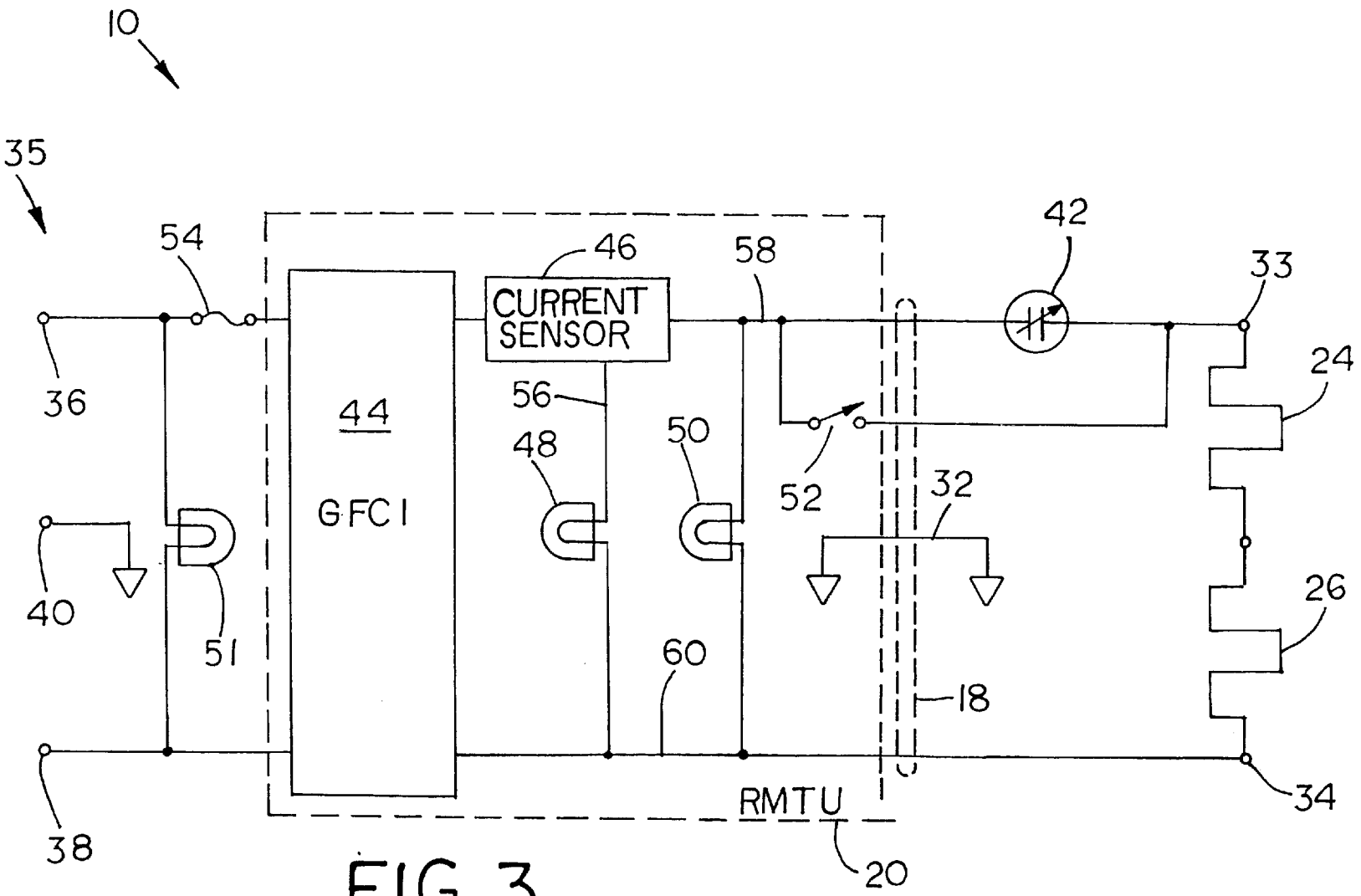
FIG. 3 is a schematic diagram of the antenna reflector deicing system of FIG. 1, including a thermostat.

Circuitry, including cable 18 and RMTU 20, for powering, monitoring and testing heaters 24 and 26 is shown schematically in FIG. 3. Each of heater wires 24 and 26, as well as cable 18, is surrounded by a grounded shield 32. Heater wires 24 and 26 include respective terminals 33 and 34. An electrical receptacle 35 functions as a source of electrical power and includes a line voltage terminal 36, a neutral terminal 38 and a ground terminal 40. Receptacle 35 supplies power to RMTU 18 and heaters 24, 26, which act as resistive heating elements. Although the wiring connections for 120 volt grounded neutral electric service are shown, any common worldwide utility voltage can be accommodated.

An automatic control element in the form of thermostat 42 is connected in series with heater 24. Thermostat 42 functions as a switch which closes when an ambient temperature falls below 40° F., thus applying electrical power to heaters 24, 26. Once having been closed, the contacts do not open until the temperature exceeds 50° F.

RMTU 20 includes a ground fault circuit interrupter (GFCI) 44, a current sensor 46, a current indicator 48, voltage indicators 50 and 51, and a test switch 52. All of these components are enclosed within a single housing 53.

An over-current device in the form of a fuse 54 protects RMTU 20 by disconnecting power if the current through fuse 54 exceeds a safe value. Fuse 54 would then need to be replaced before heaters 24, 26 could again be operated. A circuit breaker can be used in place of fuse 54. Such a circuit breaker would need to be reset before heaters 24, 26 could again be operated.

GFCI 44 detects ground fault conditions by comparing a line current in line voltage terminal 36 to a neutral current in neutral terminal 38. If the difference between the two currents exceeds 30 milliamperes, GFCI blocks current from flowing through voltage terminal 36 with an internal relay (not shown). Once GFCI 44 has been tripped, operating personnel must operate a reset switch (not shown) in order to cancel GFCI operation and allow power to be reapplied to heaters 24, 26. An indicator (not shown) may be provided to display GFCI operation.

Current sensor 46 detects the presence of a line current exceeding a threshold value, which indicates that heaters 24 and 26 are operating. This threshold value can be approximately 400 milliamperes for a reflector approximately between 1.0 and 1.2 meter in width. Upon detecting such a line current, current sensor 46 transmits a signal indicative thereof on line 56.

Status indicators including current indicator 48 and voltage indicator 50 provide status information for operating personnel. Current indicator 48 is in the form of a lamp which receives the signal from current sensor 46 on line 56 and emits visible light in response thereto. Operation of lamp 48 indicates that heaters 24, 26 are functioning.

Voltage indicator 50, for indicating that voltage is available for heaters 24, 26, is in the form of a lamp interconnecting a line voltage node 58 and a neutral node 60. When voltage is available for heaters 24, 26 at line voltage node 58, lamp 50 so indicates by emitting visible light. Lamp 50 limits the current flowing through itself to well below the threshold current, 400 milliamperes, of current sensor 46. Thus, current sensor 46 will not mistake operation of lamp 50 for operation of heaters 24, 26. Voltage indicator 51, also in the form of a lamp, indicates that receptacle 35 is supplying voltage.

In the particular embodiment shown, indicators 48, 50 and 51 are visible lamps, however light emitting diodes or audible indicators may be used as well. Other status indicators may be included to indicate temperature, the presence of snow, or a ground fault condition.

Test switch 52 is electrically connected in parallel with thermostat 42 in order to allow operating personnel to momentarily bypass thermostat 42 and thereby test heaters 24, 26 for a short period of time, even in the absence of cold temperatures and snow. The closing of switch 52 applies voltage to heaters 24, 26 and causes current indicator 48 to emit light, indicating that heaters 24, 26 are operational. Thus, the closing of test switch 52 simulates the closing of the contacts of thermostat 42, which would also apply voltage to heaters 24, 26. In addition, other switches may be provided for testing/resetting of the GFCI and for aborting heater operation.

As apparent from the foregoing description, the present invention combines the functions of testing and monitoring reflector heaters with ground fault circuit interruption in a single RMTU housing 53.

As best seen in FIG. 1, RMTU 20 is disposed at a location which is conveniently accessed by operating personnel. Such a location is necessarily remote from reflector 12, which must be placed on a rooftop or pole for best reception of airborne signals.

Figure 2:
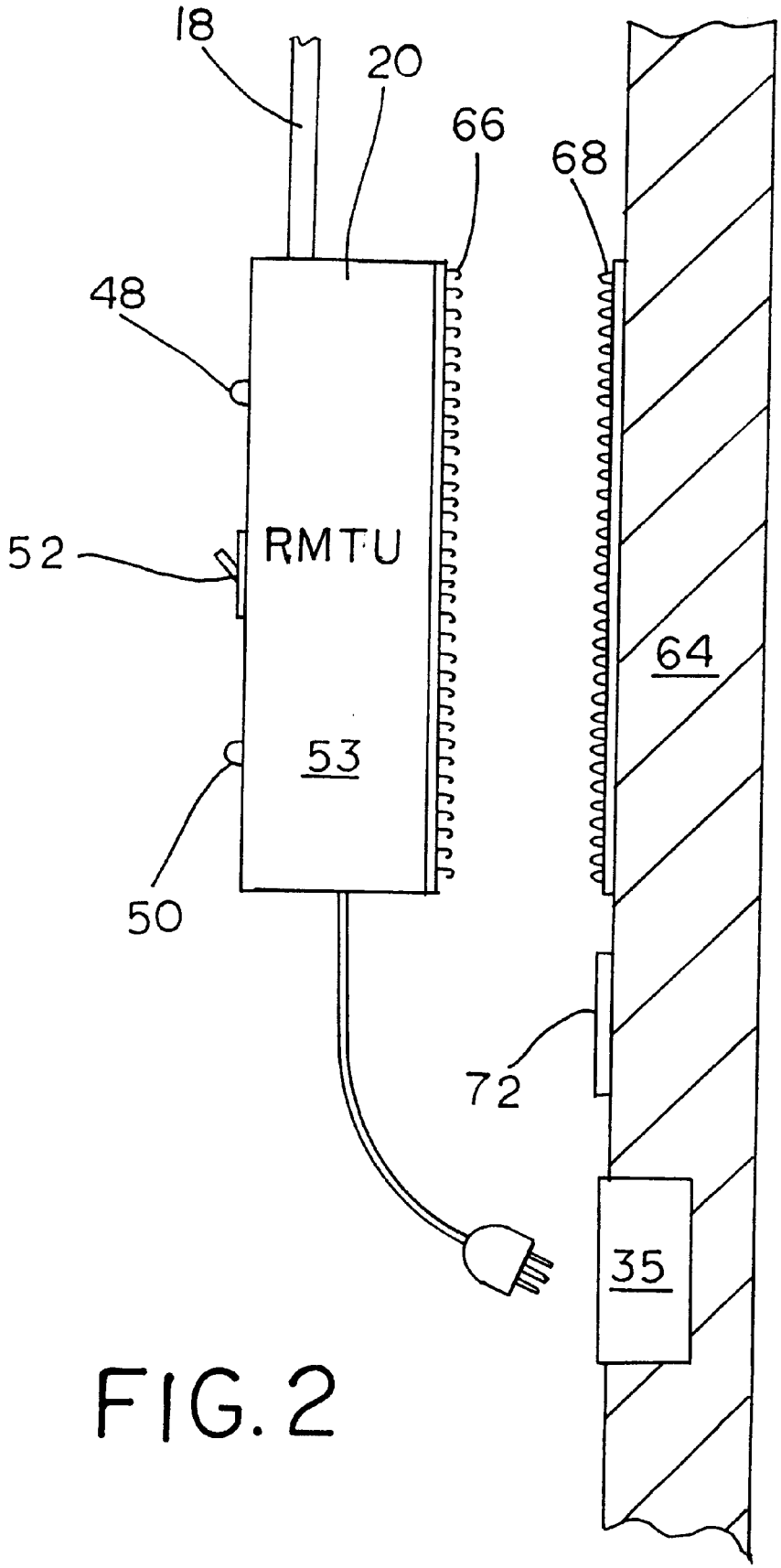
FIG. 2 is a side view of one embodiment of the remote monitor and test unit of the antenna reflector deicing system of FIG. 1, including a quick fastening device.

Housing 53 of RMTU 20 is secured to a wall 64 (FIG. 2) by a quick connect type of fastening device, which is shown in this embodiment as a Velcro® fastener including hooks 66 and loops 68. Of course, hooks 66 may also be placed on wall 64, with loops 68 being placed on RMTU housing 53.

An optional junction box 16 can be used to enclose and mechanically protect connection joints between cable 18, heater wires 24, 26 and, possibly, thermostat 42. Junction box 16 can be secured to one of support arms 28 by a hook and loop fastener in substantially the same manner that RMTU 20 is secured to wall 64. Thermostat 42 can either be attached to junction box 16 or secured to one of support arms 28 by another hook and loop fastener. Junction box 16 can also enclose connection joints for communication lines which transmit data to and from reflector 12 and feedhorn 14.

The use of quick connect fastening devices, such as hook and loop fasteners, to install RMTU 20, junction box 16 and thermostat 42 allows this heater circuitry to be easily removed and reinstalled at another reflector location if necessary. Of course, other types of quick connect fastening devices, such as a double-sided adhesive fastening device 72, can be used in place of hook and loop fasteners.

In an alternative embodiment (FIG. 4), thermostat 42 is replaced by another automatic control element, snow detector 74, which includes a microcontroller 76 (FIG. 5), an ambient temperature sensor and interface 78, and a moisture sensor and interface 80. It is to be understood that either thermostat 42, snow detector 74, or any other type of automatic control can be used in conjunction with the present invention.

The moisture sensor and interface 80 uses an on-board temperature regulated heater to convert snow and/or ice to liquid water. Water on the surface of a sensing grid is detected as a change in conductivity. An interface circuit incorporated within moisture sensor and interface 80 converts the conductivity change into a low-impedance analog signal which is transmitted to an electrical processor such as microcontroller 76 via conductor 82.

The ambient temperature sensor and interface 78 converts the ambient temperature sensor signal into an analog signal which is appropriate for inputting to the microcontroller 76 via a conductor 84. Electrical power is applied to heaters 24, 26 while moisture is present and the ambient temperature is in the operating range.

Figure 5:
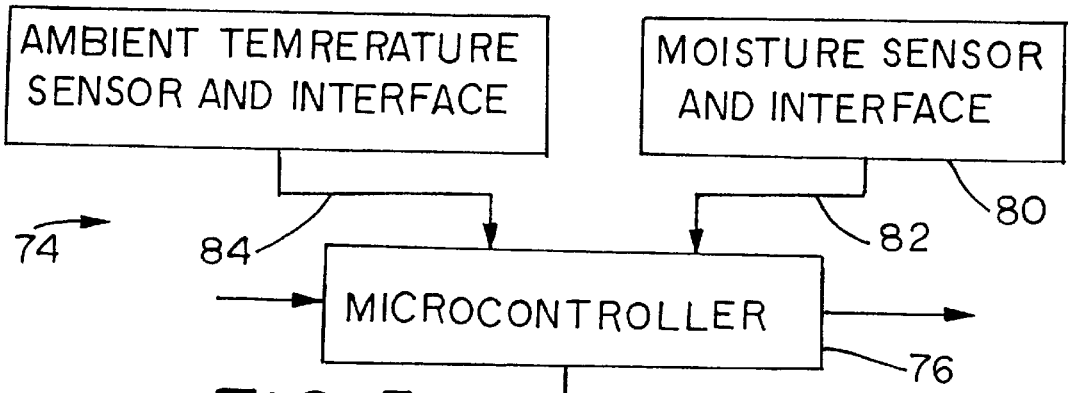
FIG. 5 is a block diagram of one embodiment of the snow detector of the antenna reflector deicing system of FIG. 4.

In the embodiment of snow detector 74 shown in FIG. 5, moisture sensor and interface 80 and ambient temperature sensor and interface 78 are shown as separate subsystems. However, it is also possible to combine moisture sensor and interface 80 and ambient temperature sensor and interface 78 into a single subsystem. An example of a single sensor which may combine the moisture sensing and ambient temperature sensing into a single unit is known, e.g., from a model CIT-1 Snow Sensor and a model GIT-1 Gutter Ice Sensor, each of which are manufactured by the Assignee of the present invention.

Figure 4:
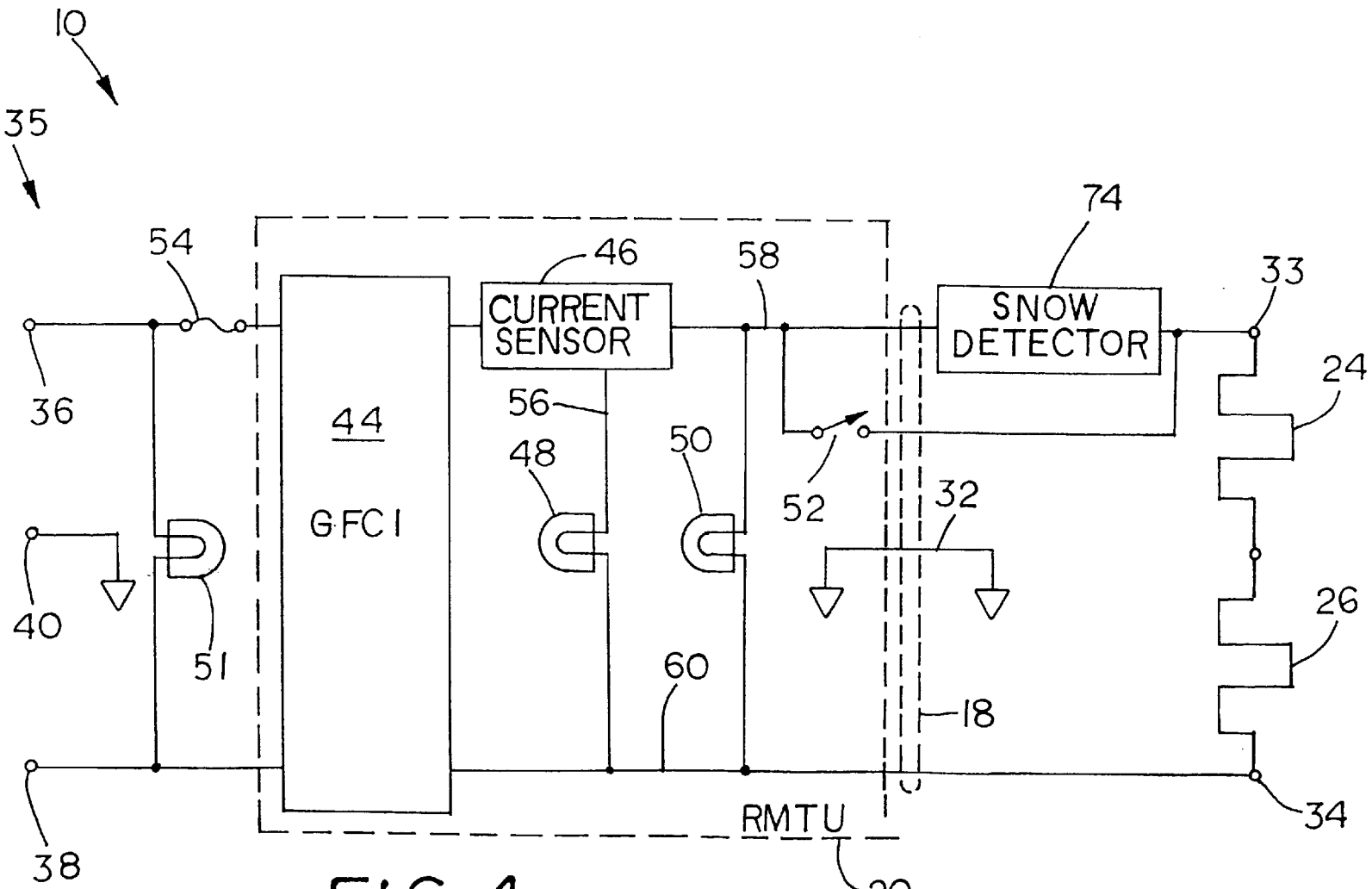
FIG. 4 is a schematic diagram of another embodiment of the antenna reflector deicing system of the present invention, including a snow detector.

In the embodiments shown in FIGS. 3 and 4, fuse 54, current sensor 46, test switch 52, thermostat 42 and snow detector 74 are all disposed on the line voltage side of heaters 24, 26. However, it is to be understood that any of these components can alternatively be placed on the neutral side of heaters 24, 26.

Figure 6:
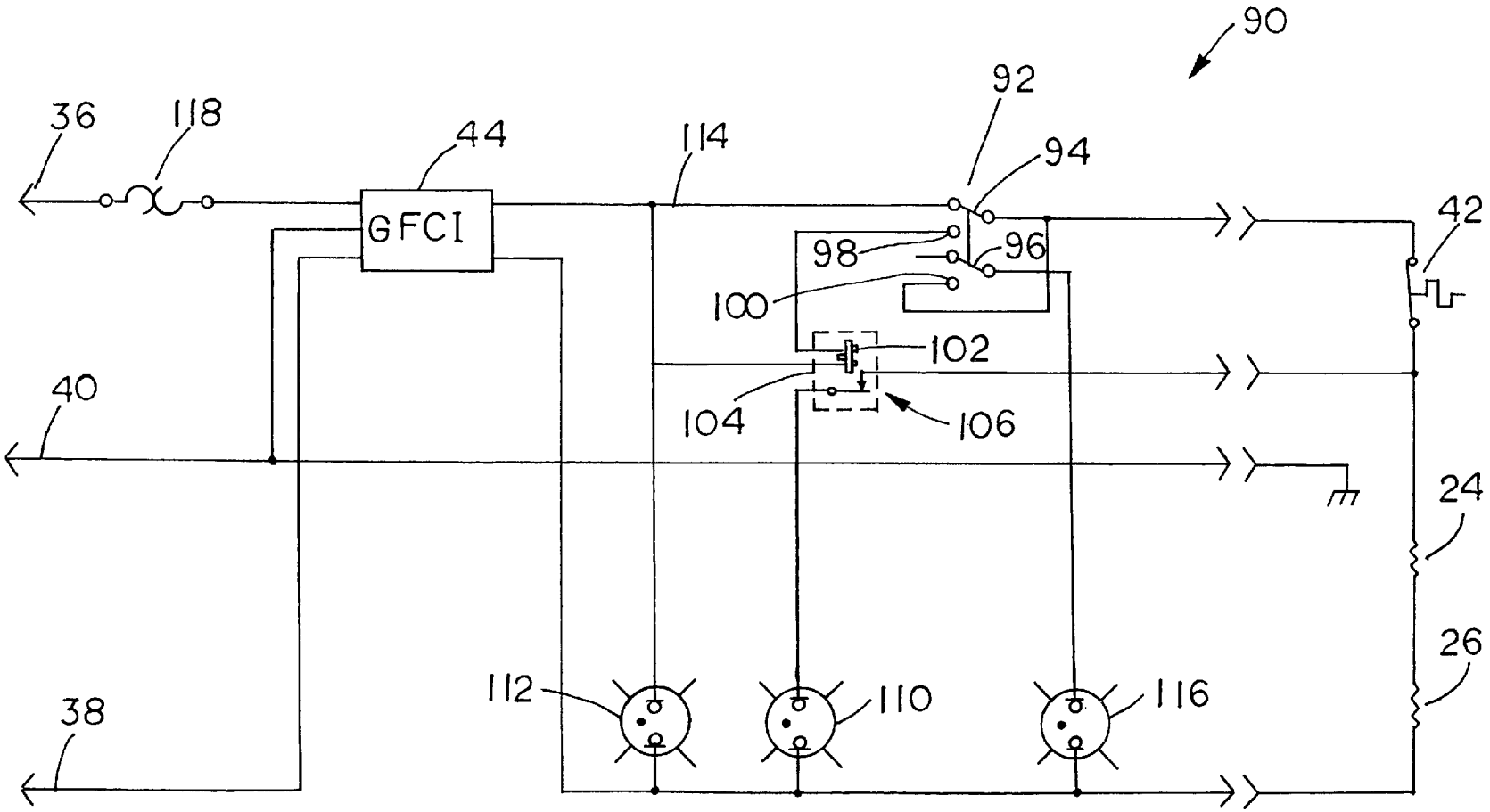
FIG. 6 is a schematic diagram of yet another embodiment of the antenna reflector deicing system of the present invention.

In yet another embodiment of an antenna reflector assembly 90 (FIG. 6), a double-pole double-throw test switch 92 is shown in its normal position during the operation of reflector heater 24, with test switch 92 directly interconnecting GFCI 44 and thermostat 42. When ambient temperature is higher than the set point of thermostat 42 and it is desired to test heaters 24 and 26, test switch 92 can be moved into its test position (not shown) in order to bypass thermostat 42. In the test position, poles 94 and 96 are pivoted into contact with terminals 98 and 100, respectively. Current then flows from GFCI 44 through coil 102 of relay 104, through terminal 98, pole 94, terminal 100, pole 96, and, finally, into reflector heater 24. Test switch 92 can be moved into its test position by pressing a button, for example, and is automatically returned to its normal position when the button is released.

Figure 7:
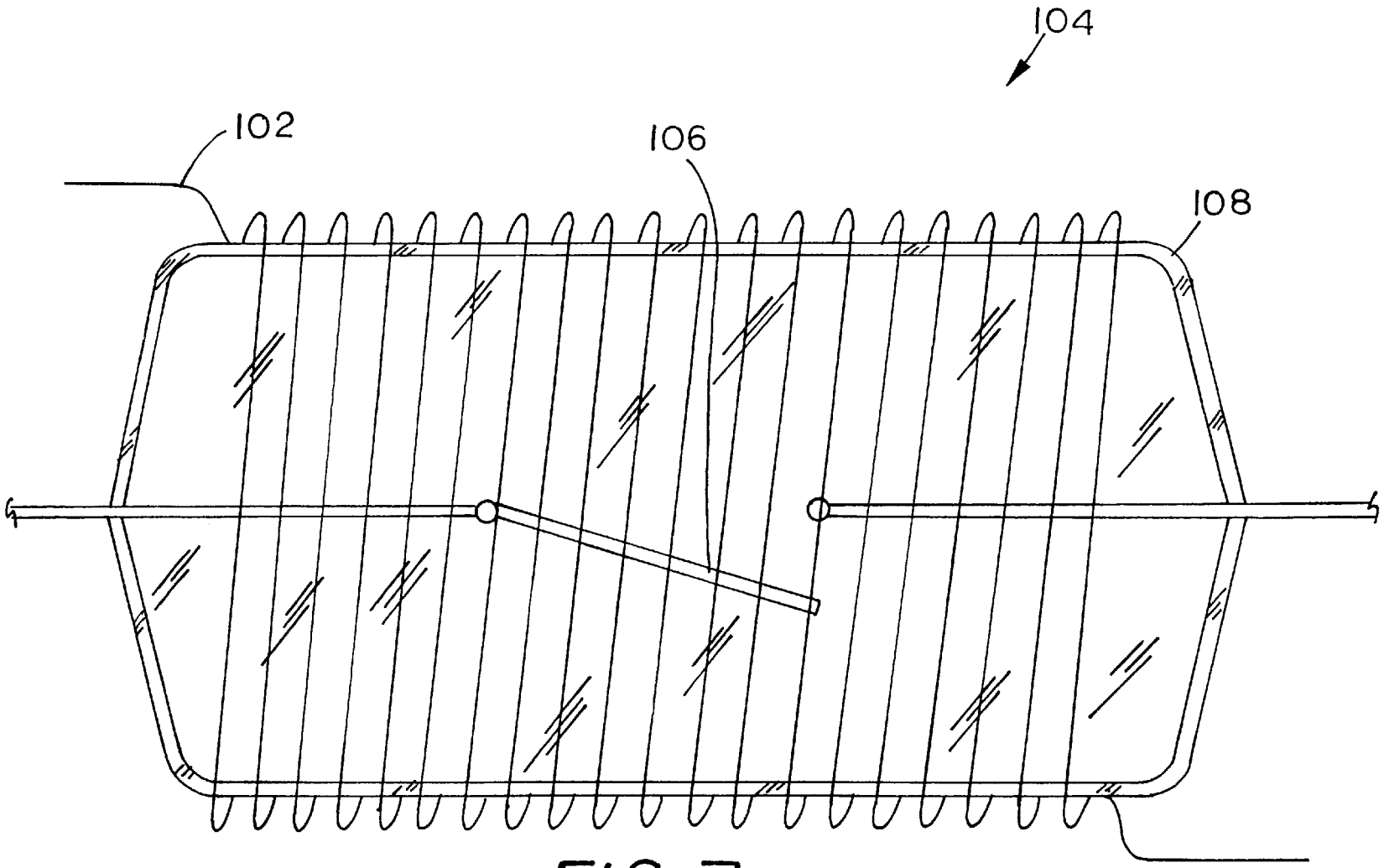
FIG. 7 is a side view of the relay of FIG. 6.

Relay 104, shown in more detail in FIG. 7, includes a reed switch 106 which is inductively closed by the magnetic field produced by the current flowing through coil 102, as is well known in the art. Reed switch 106 is hermetically sealed within an ampule-like glass tube 108. Coil 102 is wrapped around tube 108 to form a number of turns, which, in the embodiment shown, is approximately twenty. The strength of the magnetic field which causes switch 106 to close is proportional to both the number of turns and the current through coils 102.

A current-indicating neon bulb or neon glow tube 110 is connected in series with reed switch 106. Neon bulb 10 is effectively an open circuit until a breakdown voltage, such as approximately 80 volts, is applied across its terminals. After breakdown, bulb 110 emits light and current flows therethrough, as is well known in the art. This light is an indication to the user that current is flowing through heaters 24 and 26. While emitting light after breakdown, bulb 110 clamps or limits the voltage which can be applied across it to approximately 65 volts.

It would be possible to replace relay 104 and bulb 110 with a current-indicating lamp that is connected in series with heaters 24 and 26. However, it would be necessary to know the size of the reflector, and hence the power output of heaters 24 and 26, before the lamp is selected, since any particular lamp would be appropriate to use only with a specific power level. An advantage of using relay 104 is that it can be used with any size of reflector and any power level of heaters 24 and 26.

Figure 8:
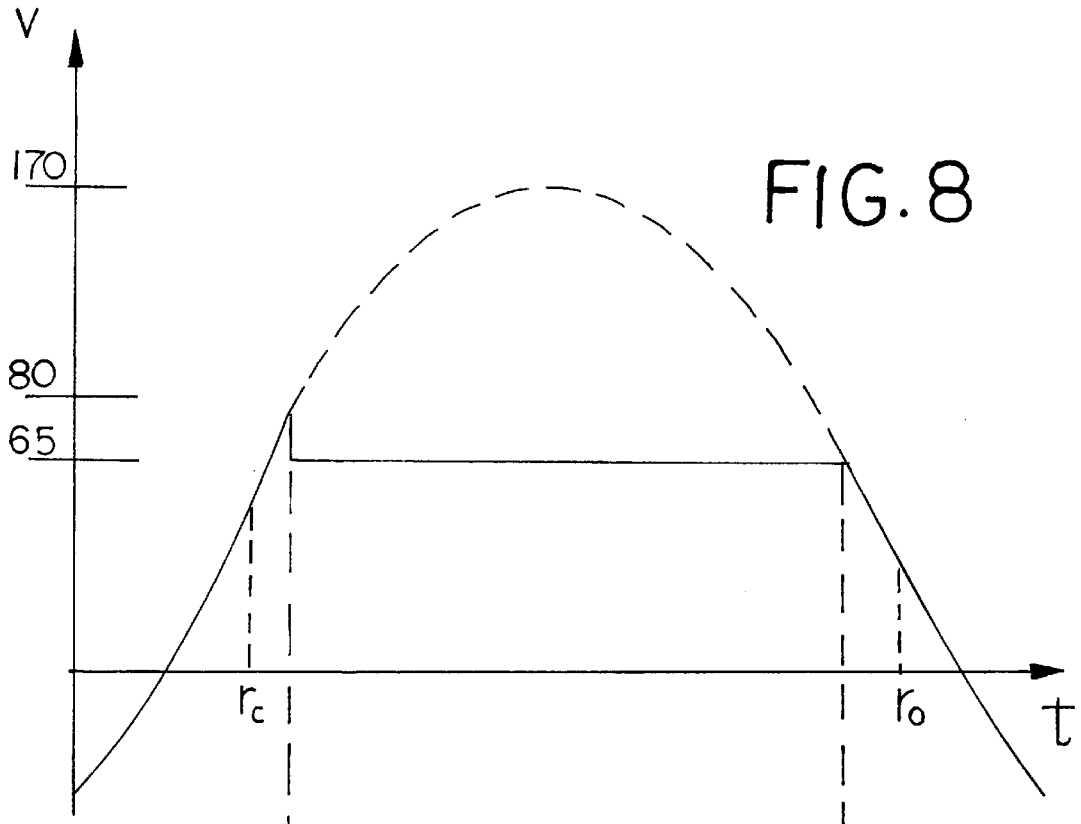
FIG. 8 is a plot of the voltage across the series combination of the relay and neon test bulb of FIG. 6, as compared to the sinusoidal input line voltage (dotted line), versus time.

A plot of the voltage across the series combination of reed switch 106 and neon bulb 110 versus time is shown in FIG. 8. The voltage across the series combination initially follows the sinusoidal line voltage as it crosses 0 volts and continues to rise. At time $r_c$, with a line voltage somewhat less than 65 volts, reed switch 106 of relay 104 closes due to the magnetic field caused by the current being carried by coil 102. This closing of reed switch 106 has no effect upon the voltage across the series combination of reed switch 106 and neon bulb 110, however, as bulb 110 is effectively still an open circuit at this point in time $r_c$.

When the voltage across the series combination of reed switch 106 and bulb 110 reaches approximately 80 volts at time $b_c$ (which is also equal to the voltage across bulb 110 alone since switch 106 is closed after time $r_c$), neon bulb 110 breaks down and begins to emit light. The line voltage continues to rise, as indicated by the dotted line, to a maximum of approximately 170 volts before dropping again in sinusoidal fashion. As mentioned above, bulb 110 limits the voltage which can be sustained across it to approximately 65 volts while bulb 110 is in its light-emitting mode.

When the line voltage, and consequently the voltage across neon bulb 110, drops slightly below 65 volts at time $b_o$, bulb 110 stops emitting light and again effectively becomes an open circuit. Later, at time $r_o$, the dropping line voltage causes the current through coil 102 to drop to a level such that reed switch 106 is again allowed to open. The magnitude of the magnetic field which causes reed switch 106 to close is higher than the magnitude of the magnetic field at which reed switch 106 is allowed to open. Thus, as shown in FIG. 8, the magnitude of the line voltage is greater at time $r_c$ when reed switch 106 closes than at time $r_o$ when reed switch 106 opens.

Figure 9:
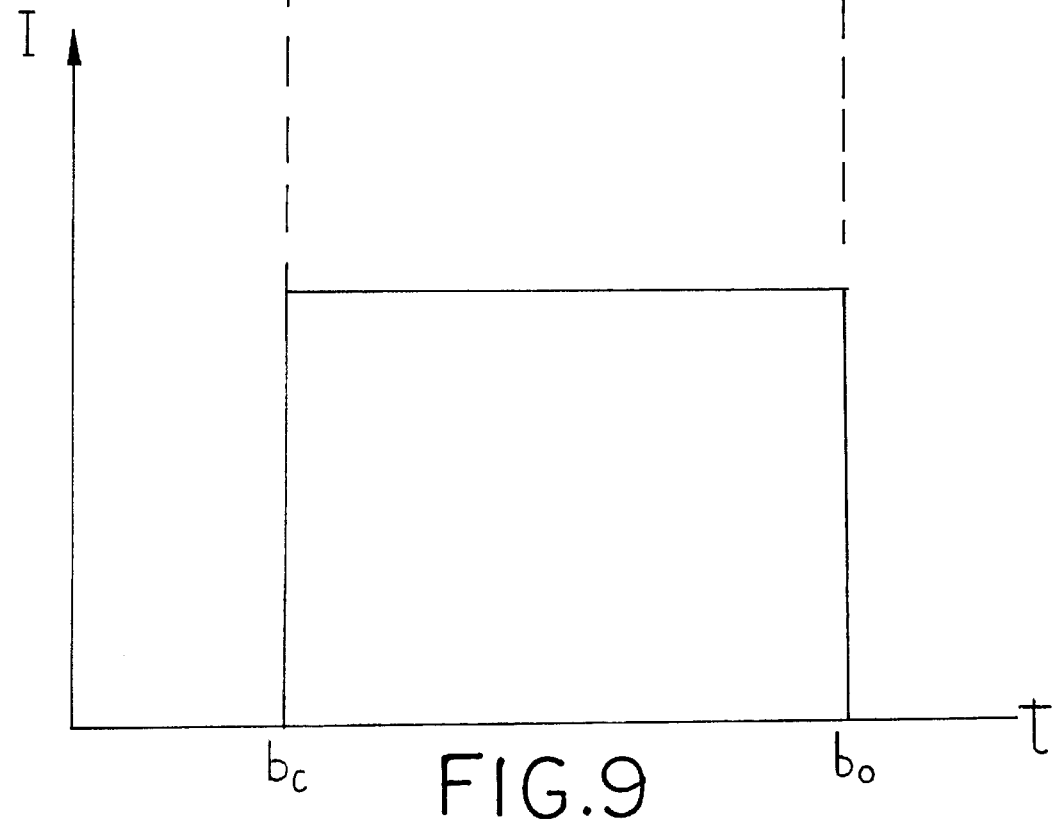
FIG. 9 is a plot of the current through the relay of FIG. 6 versus time.

The current through reed switch 106 and bulb 110 is plotted in FIG. 9. No current flows until time $b_c$ when both reed switch 106 is closed and bulb 110 has broken down and has begun to emit light. When line voltage has dropped below 65 volts at time $b_o$ and bulb 110 no longer emits light and is effectively an open circuit, current is again cut off through switch 106 and bulb 110.

While test switch 92 is held in the test position, the above-described sequence is cyclically repeated at the frequency of the line voltage, which is typically 120 Hz. When test switch 92 is returned to its normal position, current no longer flows through coil 102 and reed switch 106 remains open. Consequently, neon bulb 110 can only be activated while test switch 92 is in its test position.

As discussed above, neon bulb 110 is effectively an open circuit in the time period before and during the closing of reed switch 106. Bulb 110 is also effectively an open circuit in the time period during and after the opening of reed switch 106. Thus, a voltage is never applied across the terminals of reed switch 106 unless switch 106 is in its closed position. This absence of voltage when switch 106 is open serves to eliminate electrical arcing which might otherwise occur across the terminals of switch 106. Such electrical arcing can cause carbonization and contamination deposits on the contacts of a relay, and is a primary cause of relay failure. Thus, neon bulb 110 prevents arcing across reed switch 106, thereby prolonging the operational life of relay 104.

Another neon bulb 112 is used to indicate to the user the presence of an input line voltage being applied to line voltage node 114, similarly to voltage indicator 50 of FIG. 3. Yet another neon bulb 116, connected in parallel with reflector heater 24 and feedhorn heater 26, indicates the presence of a voltage being applied to heaters 24 and 26. Each of neon bulbs 110, 112 and 116 includes an internal current-limiting resistance element. However, it is also possible to connect respective, discrete current-limiting resistors in series with each of bulbs 110, 112 and 116.

A circuit breaker 118 electrically interconnects line voltage terminal 36 and GFCI 44. Circuit breaker 118 can be rated at approximately 3 amperes, which is well above the maximum current draw of approximately between 1 ampere and 2.5 amperes of antenna reflector assembly 90 in normal operation.

Antenna reflector assembly 90 is shown as including a thermostat 42. However, it is to be understood that a snow detector 74 could also be used in place of thermostat 42.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. An antenna reflector assembly, comprising:

a reflector having a reflecting surface;

an electrical heater configured for heating said reflecting surface;

an ambient condition sensor configured for sensing at least one of an ambient temperature and an ambient moisture associated with an ambient environment and applying electrical power to said heater dependent upon said at least one of an ambient temperature and an ambient moisture; and a test device configured for being connected to a source of electrical power, said test device including:

a circuit breaker configured for cutting off an input current to said test device when said input current exceeds a predetermined threshold current;

a ground fault circuit interrupter configured for detecting a ground fault condition and cutting off an electrical current associated with said ground fault condition;

a current indicator configured for sensing a current through said heater and providing an indication thereof; and at least one voltage indicator configured for sensing a voltage and providing an indication thereof.

2. The antenna reflector assembly of claim 1, wherein said at least one voltage indicator includes a voltage indicator configured for sensing a voltage applied across a series combination of said ambient condition sensor and said heater.

3. The antenna reflector assembly of claim 2, wherein said at least one voltage indicator includes a voltage indicator configured for sensing a voltage applied across said heater.

4. The antenna reflector assembly of claim 1, wherein each of said current indicator and said at least one voltage indicator includes at least one light-emitting device.

5. The antenna reflector assembly of claim 1, further comprising:

a feedhorn associated with said reflector; and a second electrical heater connected in series with said reflector heater, said second electrical heater being configured for heating said feedhorn.

6. The antenna reflector assembly of claim 1, wherein said test device is disposed at a location remote from said reflector.

7. The antenna reflector assembly of claim 1, wherein said source of electrical power provides a line current and one of a neutral current and a ground current, said ground fault circuit interrupter being configured for comparing said line current to said one of a neutral current and a ground current.

8. The antenna reflector assembly of claim 1, wherein said test device includes a test switch having a first position and a second position, said test switch being configured for applying said electrical power to said ambient condition sensor in said first position, said test switch being configured for allowing electrical current to flow through said current indicator and for applying said electrical power to said heater in said second position.

9. The antenna reflector assembly of claim 8, wherein said test switch comprises a double-pole double-throw switch.

10. The antenna reflector assembly of claim 1, wherein said ambient condition sensor includes a thermostat configured for sensing temperature of said ambient atmosphere and applying said electrical power to said heater when said ambient temperature falls below a first predetermined temperature.

11. The antenna reflector assembly of claim 10, wherein said thermostat is configured for removing said electrical power from said electrical heater when said ambient temperature rises above a second predetermined temperature, said second predetermined temperature being greater than said first predetermined temperature.

12. The antenna reflector assembly of claim 1 wherein said ambient condition sensor comprises a snow detector configured for sensing said ambient temperature and said ambient moisture and applying said electrical power to said electrical heater when said ambient temperature is below a predetermined temperature and said ambient moisture is above a predetermined level.

13. An antenna reflector assembly, comprising:

a reflector having a reflecting surface;

an electrical heater configured for heating said reflecting surface;

an ambient condition sensor configured for sensing at least one of an ambient temperature and an ambient moisture and applying an alternating current electrical power to said heater dependent upon said at least one of an ambient temperature and an ambient moisture; and a current indicator configured for sensing an AC electrical current through said heater and providing an indication thereof, said current indicator including:

a relay having a coil and a relay switch, said coil carrying said AC heater current, said relay switch being configured for closing when an instantaneous voltage across said heater exceeds a first threshold voltage, and for opening when said instantaneous heater voltage drops below a second threshold voltage; and an indicator device connected in series with said relay switch, said indicator device being configured for drawing current only when said instantaneous heater voltage exceeds a third threshold voltage, said third threshold voltage being greater than each of said first threshold voltage and said second threshold voltage.

14. The antenna reflector assembly of claim 13, further comprising a test switch configured for selectively allowing said AC heater current to flow through said coil, and for selectively applying said electrical power to said electrical heater.

15. The antenna reflector assembly of claim 13, wherein said indicator device includes a neon light-emitting device.

16. The antenna reflector assembly of claim 13, wherein said indicator device is configured as an open circuit whenever said relay switch is open, thereby preventing arcing across said relay switch.

17. The antenna reflector assembly of claim 13, wherein said relay switch comprises a reed switch.

18. An electrical heater assembly, comprising:

an electrical heater; and a current indicator configured for sensing an AC electrical current through said heater and providing an indication thereof, said current indicator including:

a relay having a coil and a reed switch, said coil carrying said AC heater current, said reed switch being configured for closing when an instantaneous voltage across said heater exceeds a first threshold voltage, and for opening when said instantaneous heater voltage drops below a second threshold voltage; and an indicator device connected in series with said reed switch, said indicator device being configured for drawing current only when said instantaneous heater voltage exceeds a third threshold voltage said third threshold voltage being greater than each of said first threshold voltage and said second threshold voltage.

* * * * *

UNITED STATES PATENT AND TRADEMARK OFFICE

CERTIFICATE OF CORRECTION

PATENT NO. : 6,172,647 B1
DATED : January 9, 2001
INVENTOR(S) : Thaddeus M. Jones It is certified that error appears in the above-identified patent and that said Letters Patent is hereby corrected as shown below:

Column 3,
Line 11, after thereof, insert -- . --.

Column 6,
Line 61, delete "10", and insert -- 110 --.

Column 9,
Line 43, claim 12, after 1 insert -- , --.

Signed and Sealed this

Sixteenth Day of October, 2001

*Attest:*

Nicholas P. Godici

NICHOLAS P. GODICI
*Acting Director of the United States Patent and Trademark Office*

*Attesting Officer*